US012612148B2

(12) United States Patent
Moromi et al.

(10) Patent No.: US 12,612,148 B2
(45) Date of Patent: Apr. 28, 2026

(54) MARINE PROPULSION SYSTEM, CONTROL METHOD THEREFOR, AND MARINE VESSEL

(71) Applicant: YAMAHA HATSUDOKI KABUSHIKI KAISHA, Iwata (JP)

(72) Inventors: Shuichi Moromi, Shizuoka (JP); Akihiro Tagata, Shizuoka (JP); Yuta Kubota, Shizuoka (JP); Katsutoshi Naito, Shizuoka (JP); Koshiro Inaba, Shizuoka (JP); Teppei Morishita, Shizuoka (JP); Kazumichi Yoshida, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 21 days.

(21) Appl. No.: 18/796,769

(22) Filed: Aug. 7, 2024

(65) Prior Publication Data

US 2025/0050999 A1 Feb. 13, 2025

(30) Foreign Application Priority Data

Aug. 10, 2023 (JP) ..... 2023-130809

(51) Int. Cl.
*B63H 25/42* (2006.01)
*B63H 20/12* (2006.01)
*B63H 25/02* (2006.01)

(52) U.S. Cl.
CPC ..... *B63H 25/42* (2013.01); *B63H 20/12* (2013.01); *B63H 2025/026* (2013.01)

(58) Field of Classification Search
None
See application file for complete search history.

(56) References Cited

U.S. PATENT DOCUMENTS 8,190,316 B2 5/2012 Kaji
9,988,134 B1 6/2018 Gable et al.
12,263,915 B1 * 4/2025 Koetsier ..... B63B 21/26
(Continued)

FOREIGN PATENT DOCUMENTS

JP 2008110749 A 5/2008

OTHER PUBLICATIONS

Official Communication issued in corresponding European Patent Application No. 24192318.4, mailed on Feb. 3, 2025, 12 pages.

*Primary Examiner* — Arslan Azhar
(74) *Attorney, Agent, or Firm* — Keating & Bennett, LLP

(57) ABSTRACT

A marine propulsion system includes a first propulsion device that is steerable and located at a stern of a hull, a second propulsion device that is steerable and located in front of the stern, a controller configured or programmed to include an obtaining unit to obtain information about a propulsion force of the first propulsion device in forward and backward directions, and information about a propulsion force of the second propulsion device, a determination unit to determine whether to cause the first propulsion device during a lateral motion of the hull to generate a propulsion force in a direction in a first range including a component in the forward direction, or to generate a propulsion force in a direction in a second range including a component in the backward direction based on the obtained information, and a storage to store a content determined by the determination unit.

14 Claims, 8 Drawing Sheets

(56) References Cited

U.S. PATENT DOCUMENTS

| | | | | |
|---|---|---|---|---|
| 2022/0126963 | A1 | 4/2022 | Kadobayashi | |
| 2024/0025527 | A1* | 1/2024 | Bangslund | B63H 23/06 |
| 2024/0025528 | A1* | 1/2024 | Derginer | B63H 25/42 |
| 2024/0174331 | A1* | 5/2024 | Hara | B63H 21/21 |

* cited by examiner

MARINE PROPULSION SYSTEM, CONTROL METHOD THEREFOR, AND MARINE VESSEL

CROSS REFERENCE TO RELATED APPLICATIONS

This application claims the benefit of priority to Japanese Patent Application No. 2023-130809 filed on Aug. 10, 2023. The entire contents of this application are hereby incorporated herein by reference.

BACKGROUND OF THE INVENTION

1. Field of the Invention

The present invention relates to marine propulsion systems, control methods therefor, and marine vessels.

2. Description of the Related Art

Conventionally, there is known a marine propulsion system including a propulsion device like a trolling motor (hereinafter referred to as a front propulsion device) disposed at a position in front of a stern in addition to a propulsion device like an outboard motor (hereinafter referred to as a rear propulsion device) disposed at the stern. For example, a marine vessel disclosed in U.S. Pat. No. 9,988,134 achieves a lateral motion by using an outboard motor at a stern and a trolling motor at a bow.

In general, a propulsion device capable of normal rotation and reverse rotation like an outboard motor and a propulsion device having a steerable angle of 360 degrees or more like a trolling motor can generate a propulsion force in both a forward direction and a backward direction.

The lateral motion is achieved by using either of propulsion force including a component in a forward direction (hereinafter referred to as forward propulsion force) and propulsion force including a component in a backward direction (hereinafter referred to as backward propulsion force) generated by each of the front propulsion device and the rear propulsion device and by combining a steering angle of the front propulsion device and a steering angle of the rear propulsion device.

For example, a first combination for right lateral motion is achieved when the rear propulsion device generates the propulsion force obliquely in the right backward direction and the front propulsion device generates the propulsion force obliquely in the right forward direction. A second combination is achieved when the rear propulsion device generates a propulsion force obliquely to the right forward direction and the front propulsion device generates a propulsion force obliquely to the right backward direction.

However, if a control unit determines at any time whether to cause the rear propulsion device to generate the forward propulsion force or the backward propulsion force during the lateral motion and switches the direction of the propulsion force of the rear propulsion device according to the determination result, switching of a shift position (forward or backward) of the rear propulsion device may frequently occur. Further, if a difference between the propulsion force of the front propulsion device and the propulsion force of the rear propulsion device is too large, ON/OFF of the output of the propulsion device having the larger propulsion force may be frequently repeated in order to cancel the propulsion force in the front-back direction. This may disturb the smooth lateral motion of the marine vessel.

SUMMARY OF THE INVENTION

Example embodiments of the present invention provide marine propulsion systems that enable a smooth lateral motion.

According to an example embodiment of the present invention, a marine propulsion system includes a first propulsion device that is steerable and located at a stern of a hull, a second propulsion device that is steerable and located in front of the stern, and a controller configured or programmed to define and function as an obtaining unit to obtain information about a propulsion force of the first propulsion device in a forward direction, information about a propulsion force of the first propulsion device in the backward direction, and information about a propulsion force of the second propulsion device, a determination unit to determine whether to cause the first propulsion device during a lateral motion of the hull to generate a propulsion force in a direction in a first range including a component in the forward direction, or to generate a propulsion force in a direction in a second range including a component in the backward direction based on the information about the propulsion force in the forward direction of the first propulsion device, the information about the propulsion force in the backward direction of the first propulsion device, and the information about the propulsion force of the second propulsion device obtained, and a storage processor to store a content determined by the determination unit in a storage medium as determination information.

According to another example embodiment of the present invention, a marine vessel includes a hull, and the marine propulsion system of the above example embodiment.

According to another example embodiment of the present invention, a control method for a marine propulsion system including a first propulsion device that is steerable and located at a stern of a hull and a second propulsion device that is steerable and located in front of the stern, the control method includes obtaining information about a propulsion force of the first propulsion device in a forward direction, information about a propulsion force of the first propulsion device in the backward direction, and information about a propulsion force of the second propulsion device, determining whether to cause the first propulsion device during a lateral motion of the hull to generate a propulsion force in a direction in a first range including a component in the forward direction, or to generate a propulsion force in a direction in a second range including a component in the backward direction based on the information about the propulsion force in the forward direction of the first propulsion device, the information about the propulsion force in the backward direction of the first propulsion device, and the information about the propulsion force of the second propulsion device obtained, and storing a content determined in a storage medium as determination information.

According to the above example embodiments, a smooth lateral motion is achieved.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Hereinafter, example embodiments of the present invention will be described with reference to the drawings.

Figure 1:
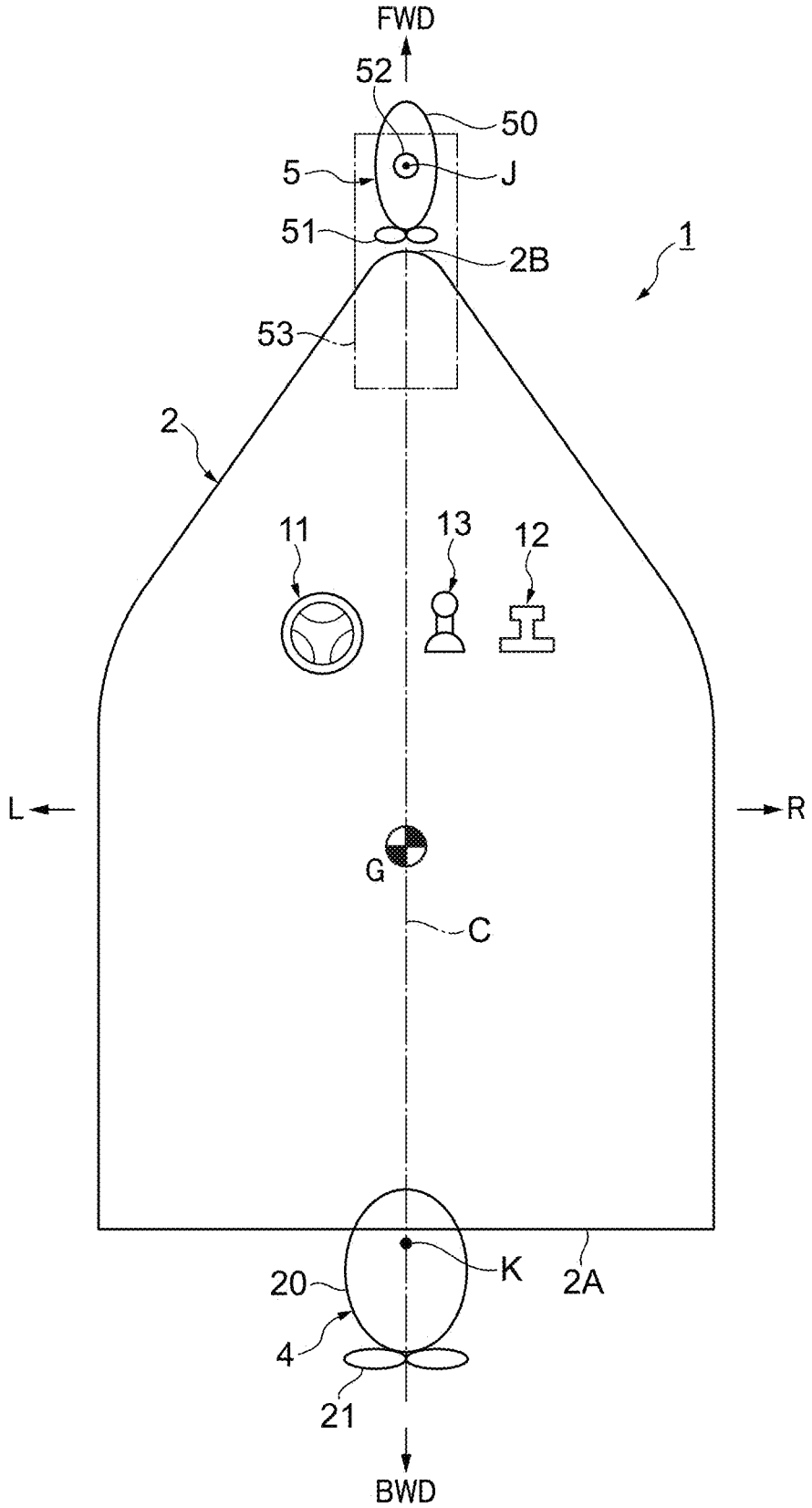
FIG. 1 is a schematic top view showing a marine vessel to which a marine propulsion system is provided.

FIG. 1 is a schematic top view of a marine vessel to which a marine propulsion system according to an example embodiment of the present invention is provided. The marine vessel 1 includes a hull 2.

In the drawings, a forward direction (bow direction) of the marine vessel 1 is indicated by an arrow FWD, and a backward direction (stern direction) is indicated by an arrow BWD. Further, a starboard direction of the marine vessel 1 is indicated by an arrow R, and a port direction thereof is indicated by an arrow L.

A center line C of the hull 2 passes through a center of a stern 2A and a tip of a bow 2B. The center line C passes through a center of gravity G (turning center) of the marine vessel 1. A front-back direction is a direction parallel to the center line C. A front is in a direction upward along the center line C shown in FIG. 1 (a direction toward the bow 2B viewed from the stern 2A). A back is in a direction downward along the center line C shown in FIG. 1. The left-right direction is based on a case where the hull 2 is viewed from the back. An up-down direction is perpendicular to the front-back direction and the left-right direction.

The marine vessel 1 includes a steerable outboard motor 4 (first propulsion device) and a steerable trolling motor 5 (second propulsion device) as propulsion devices that propel the hull 2. The outboard motor 4 is steerably disposed at the stern 2A, and the trolling motor 5 is steerably disposed in the bow 2B. The trolling motor 5 may be disposed at a predetermined position in front of the stern 2A of the hull 2, and the position of the trolling motor 5 is not limited to the bow 2B of the hull 2. The outboard motor 4 and the trolling motor 5 may be a main propulsion device and an auxiliary propulsion device, respectively, of the marine vessel 1. The single outboard motor 4 is provided at a central portion in the lateral direction of the stern 2A.

The marine vessel 1 is provided with a steering (e.g., steering wheel) 11 operated mainly for steering, a throttle operator 12 operated mainly for output adjustment of the outboard motor 4, and a joystick 13 operated mainly for steering and output adjustment of the outboard motor 4. The layout of these components is not limited to the illustrated one.

Figure 2:
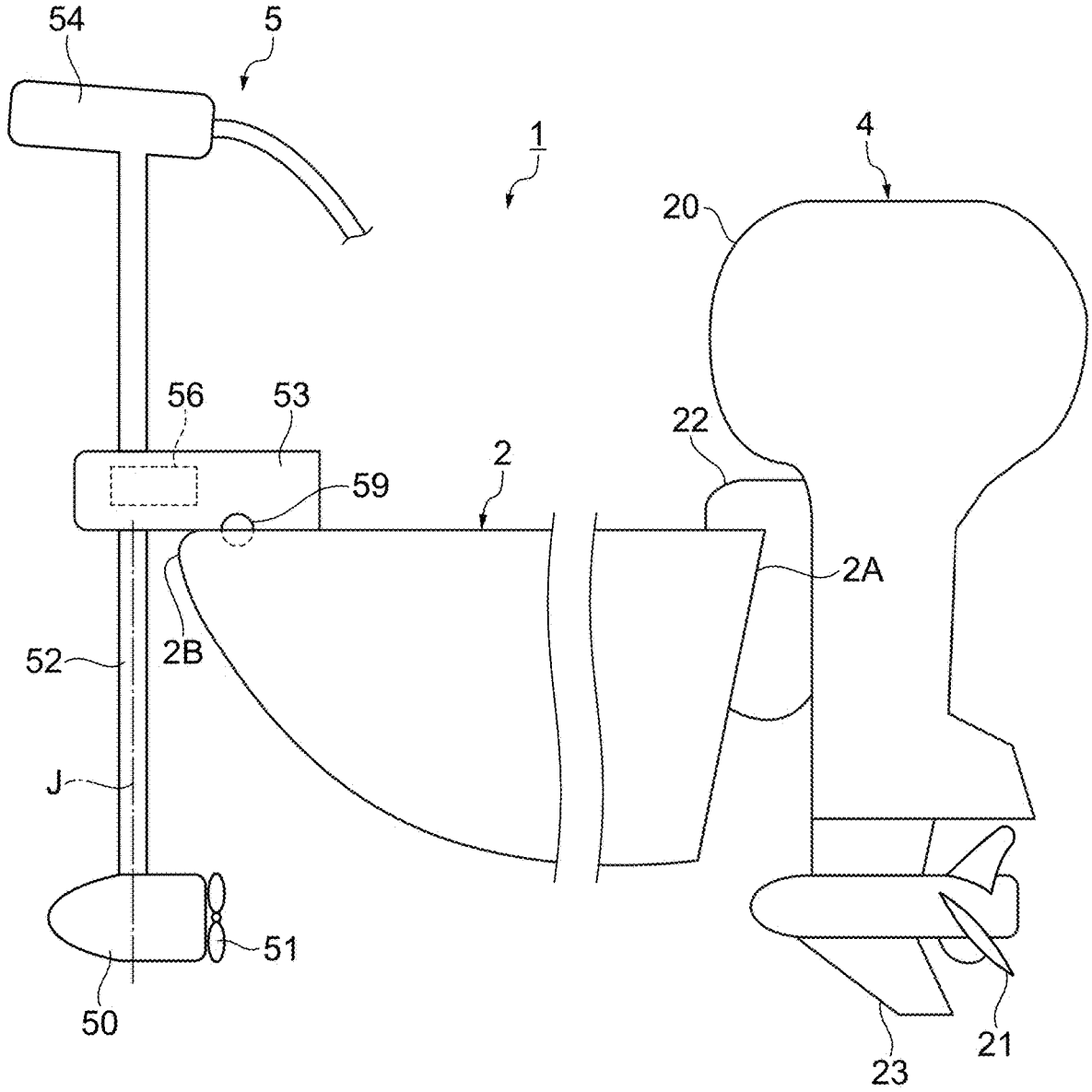
FIG. 2 is a schematic side view showing bow and stern portions of the marine vessel.

FIG. 2 is a schematic side view showing the bow portion and the stern portion of the marine vessel 1.

The outboard motor 4 includes an outboard motor body 20. A propeller 21 and a skeg (rudder) 23 are disposed in a lower portion of the outboard motor body 20. The outboard motor body 20 is mounted to the stern 2A with a mounting mechanism 22. The mounting mechanism 22 includes a clamp bracket detachably fixed to the stern 2A and a swivel bracket coupled to the clamp bracket so as to be rotatable about a tilt shaft. The outboard motor body 20 is mounted to the swivel bracket so as to be rotatable about a steering axis center K (FIG. 1). The steering angle of the outboard motor 4 is changed by rotating the outboard motor body 20 about the turning axis center K.

The trolling motor 5 is an after-part that can be externally attached to the completed marine vessel 1 later, unlike a bow thruster (not shown). The trolling motor 5 is designed to apply propulsion force to the hull 2 in any direction around a rotation axis J (FIG. 1), which is the center line of a rotation shaft 52.

The trolling motor 5 is electrically driven. The trolling motor 5 includes an electric motor 50 and a propeller 51 that is rotationally driven by the electric motor 50 to generate a propulsion force. The trolling motor 5 further includes the rotation shaft 52 extending upward from the electric motor 50 through the rotation axis J, and a bracket 53 fixed to the bow 2B and supporting the rotation shaft 52 rotatably around the rotation axis J. The electric motor 50 rotates around the rotation axis J integrally with the rotation shaft 52.

An upper portion of the rotation shaft 52 protrudes upward from the bracket 53. An operation panel 54 including an indicator (not shown) indicating the direction of the propeller 51 in the water is provided at the upper end of the rotation shaft 52. The bracket 53 is provided with an operation unit (not shown), such as a foot pedal, for a user to directly operate the trolling motor 5. In addition, a wireless remote controller (not shown) for the user to operate the trolling motor 5 may be provided. The operation panel 54 is not shown in FIG. 1.

The trolling motor 5 includes, for example, an electric steering unit 56 in the bracket 53 and rotates the rotation shaft 52 and the electric motor 50 around the rotation axis J, and an ECU (not shown) in the operation panel 54 and controls the electric motor 50 and the steering unit 56.

The steering unit 56 includes, for example, a servo motor. The trolling motor 5 is able to change its direction by a steering operation by the steering unit 56. First, the steering unit 56 changes the direction of the propulsion force generated by the rotating propeller 51 by rotating the electric motor 50 about the rotation axis J to change the direction of the electric motor 50 within a range of 360 degrees or more. This changes the steering angle of the trolling motor 5, and the direction of the propulsion force applied to the hull 2 by the trolling motor 5 changes.

The bracket 53 is vertically pivotable with respect to the hull 2 around a pivot shaft 59. The bracket 53 is rotated about the pivot shaft 59, so that the trolling motor 5 can be moved between a use position and a storage position. FIGS. 1 and 2 show a state in which the trolling motor 5 is in the use position. When the trolling motor 5 is in the use position, the electric motor 50 and the propeller 51 are located below a waterline (not shown).

In the present example embodiment, the plurality of maneuvering modes are roughly classified into an outboard motor mode in which the trolling motor 5 is not used and cooperation modes in which the trolling motor 5 and the outboard motor 4 are used in combination. The outboard motor mode is a maneuvering mode in which the outboard motor 4 is controlled mainly according to the rotation operation of the steering 11 and the operation of the throttle operator 12.

The cooperation modes include automatic maneuvering modes, a joystick mode, and a drive mode (steering wheel maneuvering mode). The joystick mode is a maneuvering mode in which the outboard motor 4 and the trolling motor 5 are controlled according to the operation of the joystick 13. The drive mode is a maneuvering mode in which the outboard motor 4 and the trolling motor 5 are controlled based on operations of various switches and paddles (described below) in the steering 11 and a rotation operation of the steering 11.

The automatic maneuvering modes are modes in which the outboard motor 4 and the trolling motor 5 are controlled to automatically hold a route, a heading, or a position of the hull 2, when a target position of the hull 2 or a target heading of the hull 2 is designated. Typical examples of the automatic maneuvering modes include a Stay Point™, a Fish Point™, and a Drift Point™.

Figure 3:
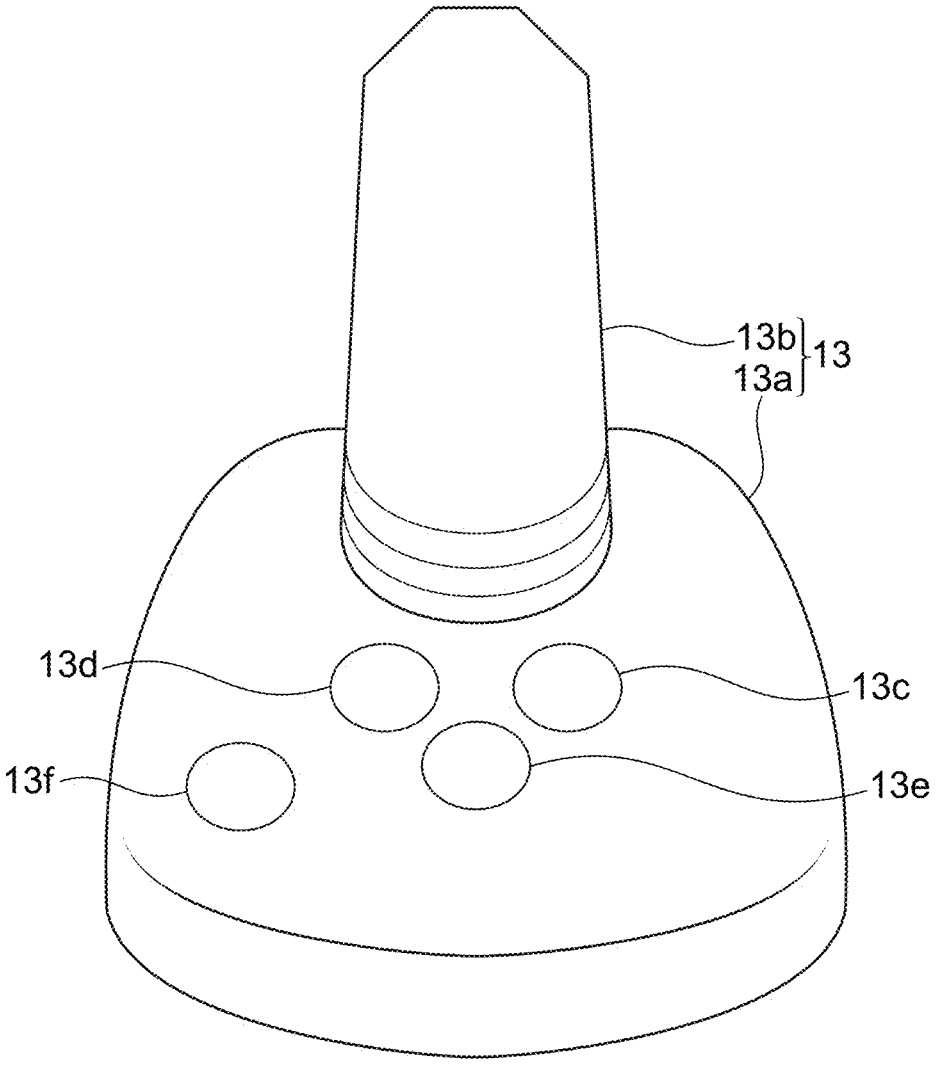
FIG. 3 is a perspective view showing a joystick.

FIG. 3 is a perspective view showing the joystick 13. The joystick 13 includes a main body 13*a* and a columnar stick 13*b* extending upward from the main body 13*a*.

A stay point button 13*c*, a fish point button 13*d*, a drift button 13*e*, and a joystick button 13*f* are arranged on the main body 13*a*. The stay point button 13*c* receives an operation of switching ON and OFF of the Stay Point™. The fish point button 13*d* receives an operation of switching ON and OFF of the Fish Point™. The drift button 13*e* receives an operation of switching ON and OFF of the Drift Point™. The joystick button 13*f* receives an operation of switching ON and OFF of the joystick mode.

The Stay Point™ is one of the automatic maneuvering modes in which the heading of the bow 2B of the hull 2 is maintained at a set target heading and the position of the hull 2 is maintained at a set target point. The Fish Point™ is one of the automatic maneuvering modes in which the hull 2 is directed to a set target point by turning the hull 2 and the moving direction of the hull 2 is maintained toward the target point. The Drift Point™ is one of the automatic maneuvering modes in which the hull 2 is moved by receiving an external force including wind and current while maintaining the heading at the bow 2B of the hull 2 in the target heading by turning the hull 2. It is not essential that all of the above-mentioned buttons are mounted on the main body 13*a*.

Figure 4:
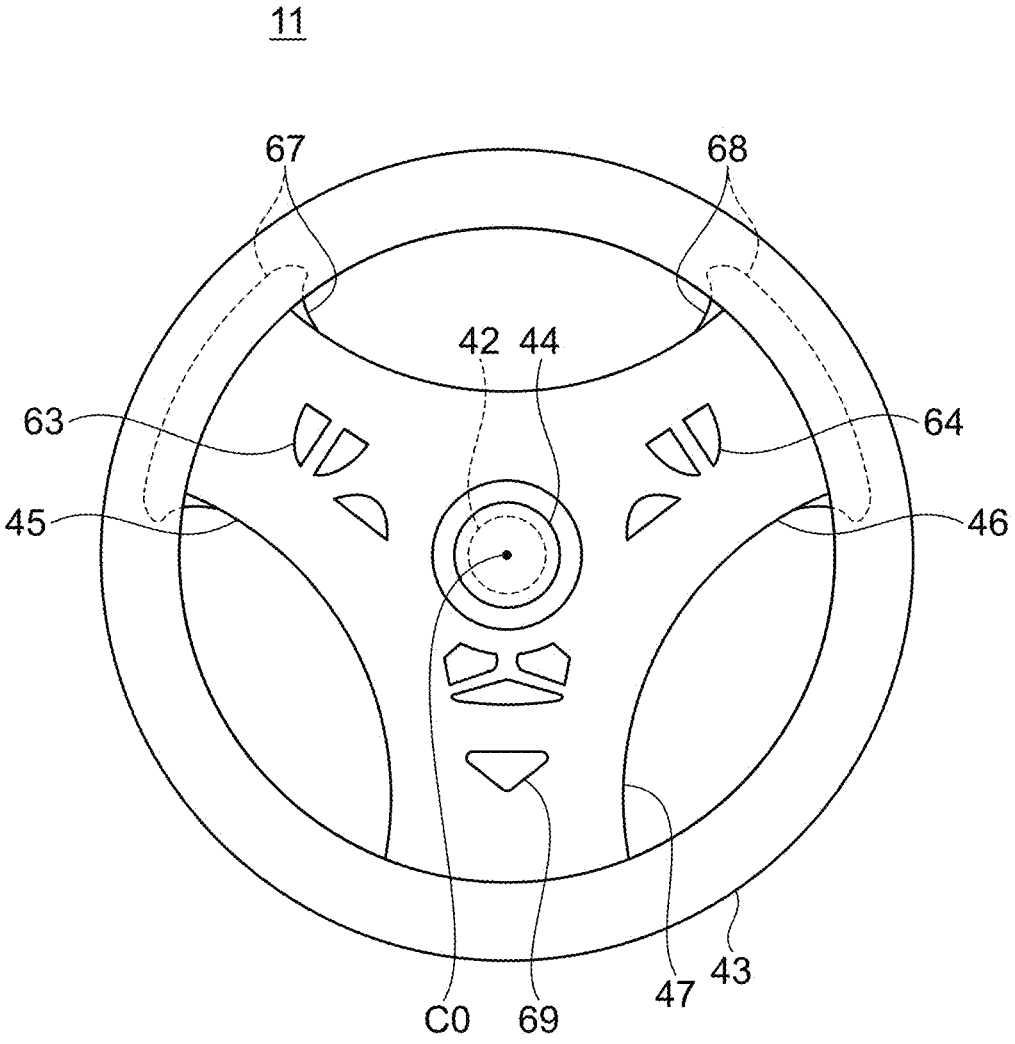
FIG. 4 is a view showing a steering wheel viewed approximately from a front.

FIG. 4 is a view showing the steering 11 viewed approximately from the front. The steering 11 includes a central portion 44, an annular wheel 43, and three spokes (a first spoke 45, a second spoke 46, and a third spoke 47). The steering 11 is supported by the hull 2 so as to be rotatable about a rotation fulcrum C0.

The steering 11 includes a plurality of switches. For example, a changeover switch 69, a left switch 63, and a right switch 64 are disposed on the surface of the steering 11. The steering 11 includes a left paddle 67 and a right paddle 68. The left paddle 67 and the right paddle 68 are pivotable in the front-back direction. The left paddle 67 and the right paddle 68 are operators to control providing the propulsion force to the hull 2 in the backward direction and the forward direction, respectively.

A controller 70 changes the magnitude of the propulsion force in the backward direction according to a throttle opening angle of the left paddle 67 when the left paddle 68 is operated. The controller 70 changes the magnitude of the propulsion force in the forward direction according to a throttle opening angle of the right paddle 68 when the right paddle 68 is operated. Mainly in the drive mode, the controller 70 controls the trolling motor 5 and the outboard motor 4 according to the operation signals of the switches 63 and 64 and the paddles 67 and 68.

The joystick mode and the drive mode enable on-the-spot turning in addition to parallel motions including a lateral motion.

The parallel motion means that the hull 2 moves in the horizontal direction without turning in a yaw direction about the center of gravity G (FIG. 1). For example, the lateral motion moves the hull 2 to the left or right without turning. Addition of the propulsion force in the front-back direction during the lateral motion enables the parallel motion of the hull 2 in an oblique direction (obliquely left, right, front, and back). The on-the-spot turning rotates the hull 2 in the yaw direction around the center of gravity G. The parallel motion and the turning may be applied in combination.

About the motions, for example, when the parallel motion is performed in the joystick mode, the hull 2 moves in parallel to a direction in which the stick 13*b* is turned. When the parallel motion is performed in the drive mode, the operations of the left switch 63 and the right switch 64 achieve leftward lateral motion and rightward lateral motion of the hull 2, respectively. When the paddles 67 and 68 are operated, the hull 2 moves backward and forward, respectively. When one of the paddles 67 and 68 is operated in parallel with the operation of the left switch 63 or the right switch 64, the hull 2 moves in parallel to an oblique direction because the forward or backward motion is added to the lateral motion.

The stick 13*b* can be operated to twist (or rotate) around the axial center of the stick 13*b*. In the joystick mode, an instruction to turn (or veer) can be given by twisting the stick 13*b*. In the drive mode, an instruction to turn (or veer) can be given by a rotation operation of the wheel 43.

Energizing elements (not shown) are provided about the tilting direction and the twisting direction of the stick 13*b* of the joystick 13, and the stick 13*b* is always biased to a neutral position. Therefore, when the user releases the stick 13*b*, the stick 13*b* automatically returns to the neutral position.

Figure 5:
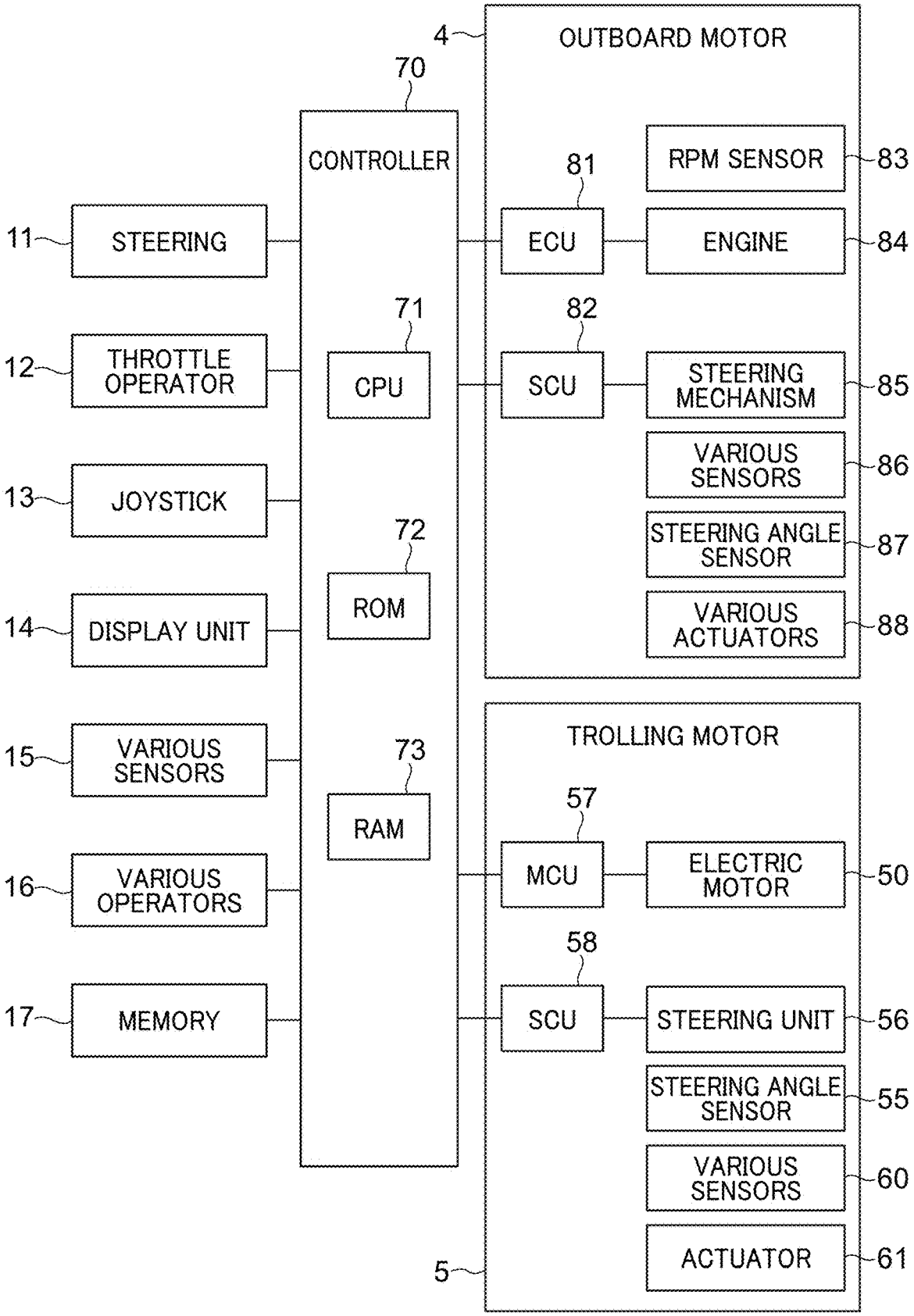
FIG. 5 is a block diagram showing a marine propulsion system.

FIG. 5 is a block diagram showing the marine propulsion system. The marine propulsion system includes a display unit 14, various sensors 15, the various operators 16, and a memory 17 in addition to the controller 70, the outboard motor 4, the trolling motor 5, the steering 11, the throttle operator 12, and the joystick 13.

The controller 70 includes a CPU 71, a ROM 72, a RAM 73, and a timer (not shown). The ROM 72 stores control programs. The CPU 71 achieves various control processes by developing the control programs stored in the ROM 72 onto the RAM 73 and executing the control programs. The RAM 73 provides a work area in executing the control programs by the CPU 71.

The various sensors 15 include a hull speed sensor, a hull acceleration sensor, a heading sensor, a distance sensor, a posture sensor, a position sensor, and a GNSS (Global Navigation Satellite System) sensor. Further, the various sensors 15 include a sensor to detect an operation of the throttle operator 12, a sensor to detect a rotational angular position of the steering 11, a sensor to detect an operation of each switch or paddle in the steering 11, and a sensor to detect an operation of the joystick 13. The hull speed sensor detects a speed (vessel speed) of the navigation of the marine vessel 1 (hull 2). The vessel speed may be obtained from a GNSS signal received by the GNSS sensor. The detection signals by the various sensors 15 are supplied to the controller 70.

The various operators 16 include setting operators to perform various settings and input operators to input various instructions in addition to operators to perform operations related to the maneuvering. Some of the various operators 16 may be arranged in the steering 11. The various operators 16 are operated by the user, and the operation signals are supplied to the controller 70. The memory 17 is preferably a readable and writable nonvolatile storage medium.

The controller 70 may exchange information with the various sensors 15 and the various operators 16 by establishing predetermined communications. The display unit 14 displays various kinds of information.

The outboard motor 4 includes an ECU (Engine Control Unit) 81, an SCU (Steering Control Unit) 82, an rpm sensor 83, an engine 84, a steering mechanism 85, various sensors 86, a steering angle sensor 87, and various actuators 88. Each of the ECU 81 and the SCU 82 includes a CPU (not shown). The ECU 81 controls the driving of the engine 84 according to an instruction from the controller 70. The SCU 82 controls the driving of the steering mechanism 85 according to an instruction from the controller 70.

The steering mechanism 85 changes the direction of the outboard motor body 20 in the left-right direction by rotating the outboard motor body 20 about the steering axis center K (FIG. 1). This changes the direction of the propulsion force acting on the stern 2A, which is the attachment position of the outboard motor body 20. The steering mechanism 85 may use an electric type or a hydraulic type. The various actuators 88 may include a power trim and tilt mechanism (PTT mechanism) that rotates the outboard motor 4 about a tilt axis.

The rpm sensor 83 detects the number of rotations per unit time period of the engine 84 (an engine rotation speed). The various sensors 86 include a throttle opening sensor. The steering angle sensor 87 detects an actual steering angle of the outboard motor 4. The controller 70 may obtain the actual steering angle from a steering instruction value output to the steering mechanism 85.

The trolling motor 5 includes an MCU (Motor Control Unit) 57, an SCU (Steering Control Unit) 58, a steering angle sensor 55, various sensors 60, and an actuator 61 in addition to the electric motor 50 and the steering unit 56.

The MCU 57 and the SCU 58 include CPUs (not shown), respectively. The MCU 57 controls the driving of the electric motor 50 according to an instruction from the controller 70. The maximum output of the electric motor 50 may be less than the maximum output of the engine 84 of the outboard motor 4. The SCU 58 controls the driving of the steering unit 56 according to an instruction from the controller 70 to change the direction of the propulsion force acting on the bow 2B, which is the attachment position of the trolling motor 5.

The actuator 61 moves the trolling motor 5 between the use position and the storage position. It is not essential to provide a function of moving the trolling motor 5 between the use position and the storage position by power.

The steering angle sensor 55 detects the steering angle of the trolling motor 5 changed by the steering unit 56. The detection signals by the steering angle sensor 55 and the various sensors 60 are supplied to the controller 70. It is not essential that the outboard motor 4 and the trolling motor 5 include all of the above-described sensors and actuators.

Strictly speaking, the propulsion force of each propulsion motor acts on the point at which each propulsion motor is attached to the hull 2. However, it will be assumed that the propulsion force of the trolling motor 5 acts on the bow 2B and the propulsion force of the outboard motor 4 acts on the position of the attachment mechanism 22 on the stern 2A for convenience of description.

Figure 6A:
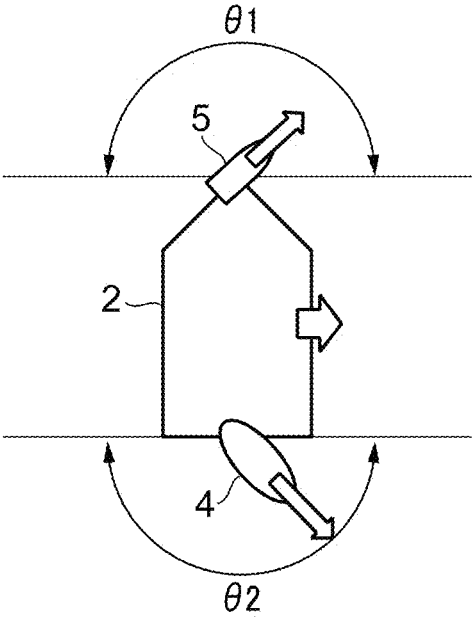
FIGS. 6A and 6B are schematic views for explaining a direction of propulsion force of an outboard motor and a direction of propulsion force of a trolling motor during a rightward lateral motion.
Figure 6B:
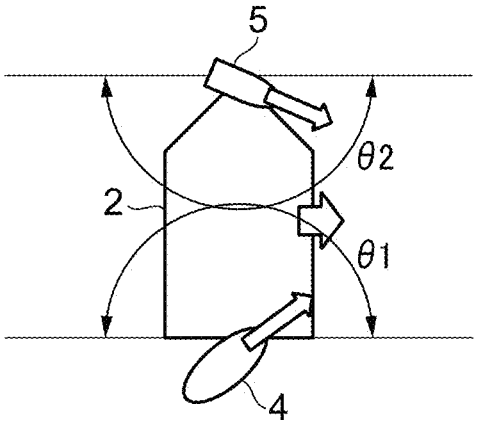

FIGS. 6A and 6B are schematic views for describing the direction of the propulsion force of the outboard motor 4 and the direction of the propulsion force of the trolling motor 5 during the rightward lateral motion. The directions of propulsion force of the outboard motor 4 are divided into a first range θ1 (that is, an angular range of 180° in the forward direction) including a component in the forward direction and a second range θ2 (that is, an angular range of 180° in the backward direction) including a component in the backward direction. Similarly, the directions of propulsion force of the trolling motor 5 are divided into the first range θ1 and the second range θ2. The direction of the propulsion force is equivalent to the direction of the outboard motor 4 or the trolling motor 5.

In the example shown in FIG. 6A, the direction of propulsion force of the outboard motor 4 is included in the second range θ2, and the direction of propulsion force of the trolling motor 5 is included in the first range θ1. In the example shown in FIG. 6B, the direction of propulsion force of outboard motor 4 is included in the first range θ1, and the direction of propulsion force of the trolling motor 5 is included in the second range θ2. Any combinations in FIGS. 6A and 6B enable the lateral motion, for example, if both the propulsion forces have components in the rightward direction, the hull 2 laterally moves in the right direction.

The rotation of the propeller 21 of the outboard motor 4 can be reversed by switching the shift position, and therefore, the direction of the propulsion force generated by the outboard motor 4 is actually determined according to the steering angle of the outboard motor 4 and the rotation direction of the propeller 21. Since the trolling motor 5 can be steered by 360 degrees, the direction of the propulsion force to be generated is determined by the steering angle of the trolling motor 5.

If the state shown in FIG. 6A and the state shown in FIG. 6B are frequently switched during the lateral motion, the shift position of the outboard motor 4 is frequently switched, which may disturb a smooth lateral motion of the marine vessel.

Therefore, in this example embodiment, the controller 70 determines whether to cause the outboard motor 4 during the lateral motion of the hull 2 to generate the propulsion force in the direction in the first range θ1 or to generate the propulsion force in the direction in the second range θ2, and stores information about the determination in the memory 17. Such a determination process (described below with reference to FIG. 7) shall be executed as part of a calibration before the first use of the marine vessel 1 after the outboard motor 4 and the trolling motor 5 are mounted on the marine vessel 1. However, this configuration is not limiting. The determination process may be executed at the time of replacement or maintenance of the outboard motor 4 or the trolling motor 5, or may be executed at a desired timing in response to an instruction from the user.

Figure 7:
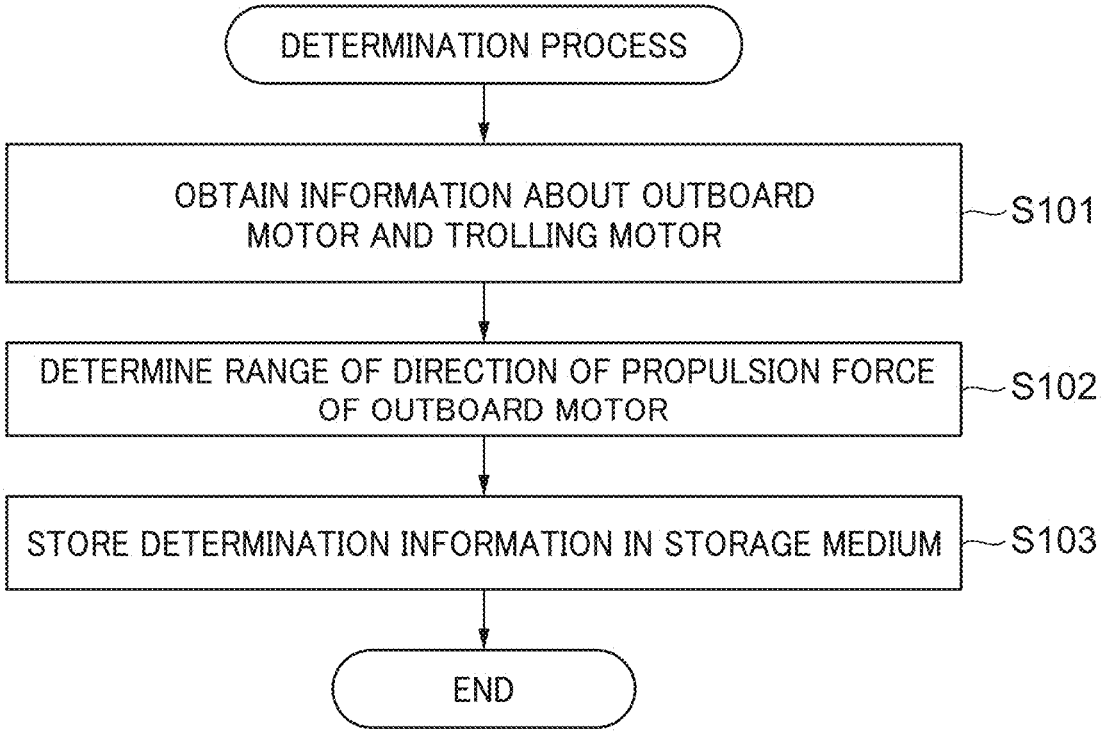
FIG. 7 is a flowchart showing a determination process.

FIG. 7 is a flowchart showing the determination process. This process is implemented by the CPU 71 developing a program stored in the ROM 72 onto the RAM 73 and executing the program. This process is started, for example, when the user or a maintenance person instructs the start of the determination process.

In a step S101, the controller 70 configured or programmed to define and function as an obtaining unit obtains propulsion force information about the outboard motor 4 and the trolling motor 5. The method of obtaining the information is not limited. For example, the controller 70 obtains the respective propulsion force information by communication or from information input by the user.

First, the propulsion force information about the outboard motor 4 includes information about the propulsion force in the forward direction and information about the propulsion force in the backward direction. At least the minimum value of propulsion force in the forward direction (hereinafter referred to as forward minimum propulsion force $F_{min}$) and the minimum value of propulsion force in the backward direction (hereinafter referred to as backward minimum propulsion force $R_{min}$) are obtained. Further, the maximum steering angle information about the outboard motor 4 and the information about a distance from the center of gravity G to the outboard motor 4, and the like are obtained.

The controller 70 may calculate the forward minimum propulsion force $F_{min}$ and the backward minimum propulsion force $R_{min}$ from the forward/backward minimum propulsion force at the maximum steering angle. Further, the forward minimum propulsion force $F_{min}$ and the backward minimum propulsion force $R_{min}$ may be calculated based on the rotation speed of the engine 84 (a drive source) in a fully closed position of the throttle. At least one of the value at the maximum steering angle and the value in a fully closed position of the throttle may be considered.

The propulsion force information about the trolling motor 5 includes information about the maximum value of the propulsion force (hereinafter referred to as the motor maximum propulsion force $M_{max}$) and the distance from the center of gravity G to the trolling motor 5.

Instead of obtaining or calculating each piece of information as described above, the controller 70 may obtain each piece of information described above by obtaining format information about each of the outboard motor 4 and the trolling motor 5 and referring to a map stored in the ROM 72 in advance.

In order to laterally move the hull 2 without turning the head of the hull 2, it is necessary to prevent generation of a moment around the center of gravity G by each propulsion force of the outboard motor 4 and the trolling motor 5. Therefore, when determining the forward minimum propulsion force $F_{min}$, the backward minimum propulsion force $R_{min}$, and the motor maximum propulsion force $M_{max}$, the controller 70 may consider the distance from the center of gravity G to each of the outboard motor 4 and the trolling motor 5.

In a step S102, the controller 70 configured or programmed to define and function as a determination unit determines the range of the direction of the propulsion force of the outboard motor 4 used during the lateral motion of the hull 2, that is, determines whether to cause the outboard motor 4 to generate the propulsion force in the direction in the first range θ1 or to generate the propulsion force in the direction in the second range θ2.

First, the controller 70 obtains a first absolute value of a difference (first difference) between the forward minimum propulsion force $F_{min}$ and the motor maximum propulsion force $M_{max}$. The first absolute value is represented by $|F_{min}-M_{max}|$. Further, the controller 70 obtains a second absolute value of a difference (second difference) between the backward minimum propulsion force $R_{min}$ and the motor maximum propulsion force $M_{max}$. The second absolute value is represented by $|R_{min}-M_{max}|$.

Then, the controller 70 compares the first absolute value with the second absolute value. When the first absolute value is less than the second absolute value, the range of the direction of the outboard motor 4 used is determined as the first range θ1. When the first absolute value is more than the second absolute value, the range of the direction of the outboard motor 4 used is determined as the second range θ2.

Therefore, the range corresponding to the forward minimum propulsion force $F_{min}$ or the backward minimum propulsion force $R_{min}$ of which difference from the motor maximum propulsion force $M_{max}$ is smaller is determined as the range of the direction of the outboard motor 4 used.

Here, if the forward minimum propulsion force $F_{min}$ or the backward minimum propulsion force $R_{min}$ is more than the motor maximum propulsion force $M_{max}$, it may be necessary to repeat turning ON and OFF (shift-in and shift-out) the output of the outboard motor 4 in order to cancel the propulsion force component in the front-back direction during the lateral motion. However, the forward minimum propulsion force $F_{min}$ or the backward minimum propulsion force $R_{min}$ of which difference from the motor maximum propulsion force $M_{max}$ is smaller is used as described above, the frequency of repeating ON and OFF of the output of the outboard motor 4 is reduced or prevented. This enables the smooth lateral motion.

When the first absolute value is identical to the second absolute value, the range of the direction of the outboard motor 4 used may be determined to be a predetermined range (for example, the first range θ1). Moreover, when the difference between the first absolute value and the second absolute value falls within a predetermined range, the range of the direction of the outboard motor 4 used may be determined to be the predetermined range.

The range of the orientation of the trolling motor 5 used is determined to be opposite to the range of the direction of the outboard motor 4. For example, when the range of the direction of the outboard motor 4 is determined as the first range θ1, the range of the direction of the trolling motor 5 is determined as the second range θ2. The determined contents (the ranges of the directions of the outboard motor 4 and the trolling motor 5) constitute the determination information. It is not essential to include the range of the direction of the trolling motor 5 in the determination information.

The controller 70 configured or programmed to define and function as a storage processing unit stores the determination information determined in the step S102 in the memory 17 in a step S103, and ends the determination process (FIG. 7).

Figure 8:
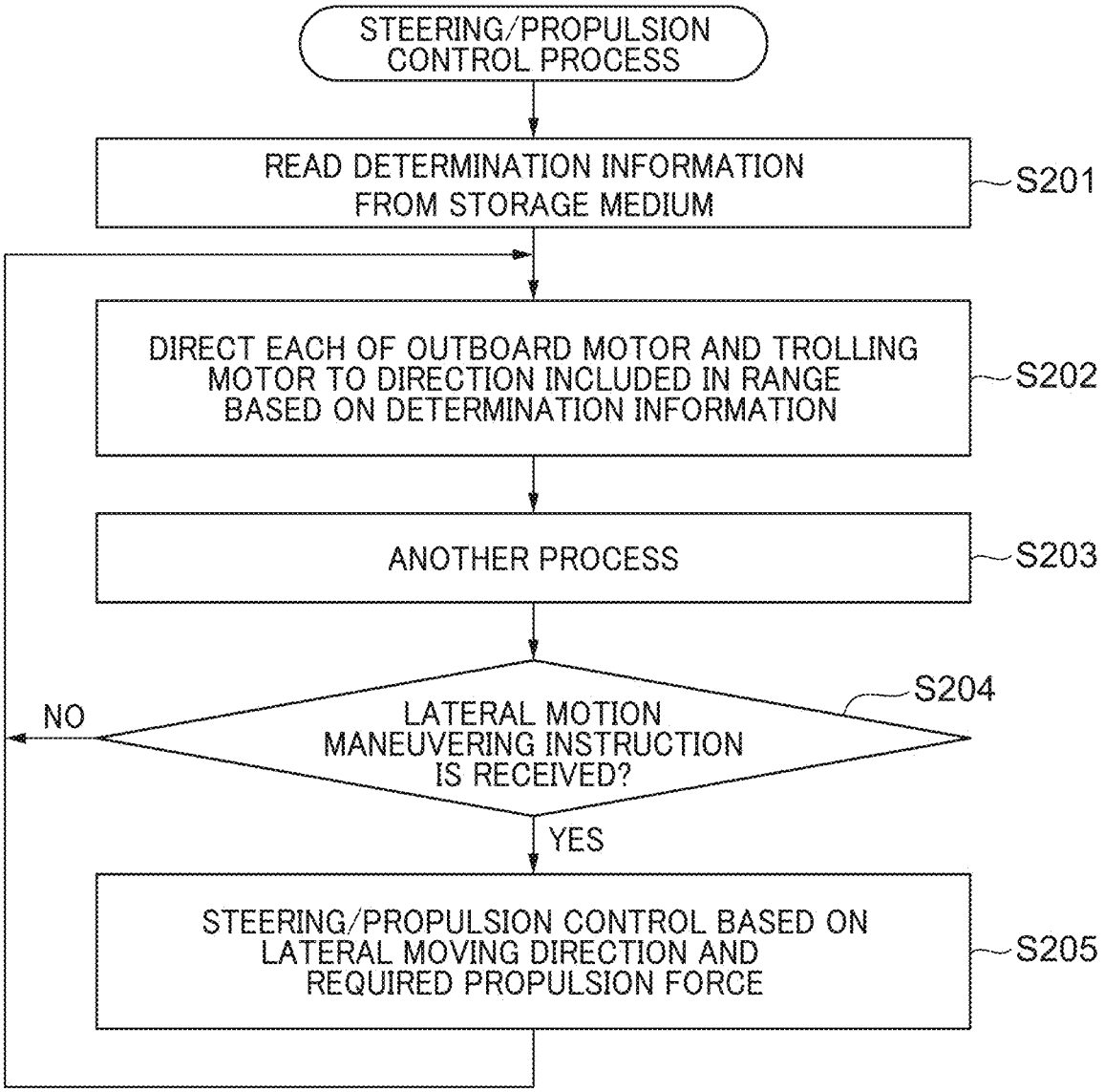
FIG. 8 is a flowchart showing a steering/propulsion control process.

FIG. 8 is a flowchart showing a steering/propulsion control process. This process is achieved by the CPU 71 developing a program stored in the ROM 72 onto the RAM 73 and executing the program. This process is based on the premise that the determination process (FIG. 7) has already been executed and the determination information has been stored in the memory 17.

This process is started, for example, in response to input of an instruction to start a maneuvering mode (for example, the cooperation mode) that may require the lateral motion or in response to an instruction to start a lateral motion mode. Therefore, the time point at which a situation that may need the lateral motion occurs becomes the start timing of the direction change, and the process of keeping the outboard motor 4 directed in the direction based on the determination information is started by the process from a step S201, which leads to the shortening of the period of time until the actual start of the lateral motion.

In the step S201, the controller 70 reads the determination information from the memory 17. In a step S202, the controller 70 controls the steering mechanism 85 to change the steering angle so that the direction of the propulsion force of the outboard motor 4 is directed in a direction included in the range based on the determination information. At the same time, the controller 70 controls the steering unit 56 to change the steering angle so that the direction of the trolling motor 5 is directed in a direction included in the range based on the determination information.

As an example, when it is unclear which of the left and right lateral motion is actually instructed, each steering angle is controlled so that each propulsion force is directed in a direction parallel to the center line C (FIG. 1) of the hull 2 within a range based on the determination information. At this time, it is not essential to reverse the range of the direction of trolling motor 5 to the range of the direction of the outboard motor 4.

In a step S203, the controller 70 executes another process. Here, if there is a maneuvering instruction other than the lateral motion, the controller 70 executes a process corresponding to the maneuvering instruction. Further, if there is an instruction to end the steering/propulsion control process (FIG. 8), the controller 70 ends this process.

In a step S204, the controller 70 determines whether a lateral motion maneuvering instruction is received. The lateral motion maneuvering instruction referred to here also includes an instruction for a parallel translation (oblique motion) including a lateral direction component. Here, in the joystick mode, the maneuvering instruction, the target direction, and the required propulsion force of the lateral motion are input by the tilting operation of the stick 13*b*. Further, an instruction for turning (or veering) or the like is input by a twisting operation of the stick 13*b*.

In the drive mode, the maneuvering instruction is input from one operation or a combination of two or more operations of the wheel 43, first operation instructors, and second operation instructors. The switches 63 and 64 correspond to the first operation instructors to generate an instruction to provide a propulsion force in the lateral direction to the hull 2. The paddles 67 and 68 correspond to the second operation instructors to generate an instruction to provide a propulsion force in the front-back direction to the hull 2. For example, a lateral motion maneuvering instruction and a target direction are input by a combination of operations of the switches 63 and 64 and the paddles 67 and 68, and a required propulsion force is input by a combination of the operation amounts thereof. Further, an instruction for turning (or veering) or the like is input by the rotational operation of the wheel 43.

Then, the controller 70 returns the process to the step S202 when no lateral motion maneuvering instruction is received, or proceeds with the process to a step S205 when the lateral motion maneuvering instruction is received.

In the step S205, the controller 70 achieves the instructed lateral motion by controlling the steering angles and the propulsion forces of the outboard motor 4 and the trolling motor 5 according to the target direction and the required propulsion force indicated by the maneuvering instruction. Normally, the directions of the outboard motor 4 and the trolling motor 5 during the lateral motion are within the ranges corresponding to the determination information, and thus the lateral motion is smooth. After the step S205, the controller 70 returns the process to the step S202.

Although not shown, the marine vessel 1 includes functional blocks to implement the determination process (FIG. 7) and the steering/propulsion control process (FIG. 8). Functional units included in the functional block include the obtaining unit, the determination unit, the storage processing unit, and the controller. The functions of these functional units are implemented mainly by cooperation of the CPU 71, ROM 72, RAM 73, sensors 15, 55, 60, 83, 86, and 87, etc.

According to this example embodiment, the information about the propulsion force in the forward direction of the outboard motor 4, the information about the propulsion force in the backward direction of the outboard motor 4, and the propulsion force information about the trolling motor 5 are obtained. And based on these, the controller 70 determines whether to cause the outboard motor 4 to generate the propulsion force in the direction in the first range θ1 or to generate the propulsion force in the direction in the second range θ2. The determined contents are stored in the memory 17 as the determination information. Thus, the range of the direction of the outboard motor 4 is fixed in one of the first range θ1 and the second range θ2 during the lateral motion, and therefore, the shift position is not frequently switched. This enables the smooth lateral motion.

The range of the direction of the outboard motor 4 used is determined as the first range θ1 when the first absolute value is less than the second absolute value, and is determined as the second range θ2 when the first absolute value is more than the second absolute value. This reduces the frequent repetition of turning ON and OFF of the output of the outboard motor 4, which enables the smooth lateral motion.

Moreover, if the distance between the outboard motor 4 and the center of gravity G and the distance between the trolling motor 5 and the center of gravity G are taken into consideration in determining the forward minimum propulsion force $F_{min}$, the backward minimum propulsion force $R_{min}$, the motor maximum propulsion force $M_{max}$, and the range of the direction of the outboard motor 4, the accuracy of determining the range of the direction of the outboard motor 4 is further improved.

Further, since the steering/propulsion control process (FIG. 8) is started in response to the occurrence of the situation that may need the lateral motion, a time period to start the actual lateral motion can be shortened.

When controlling the steering angles and the propulsion forces of the outboard motor 4 and the trolling motor 5 in the step S205, the controller 70 maintains the steering angle of the trolling motor 5 in the range determined based on the determination information. Thus, the steering angle range does not exceed 180°, and therefore excessive rotation is prevented in a configuration that limits the steering angle, and entwining of a harness is also prevented.

In the applications of example embodiments of the present invention, the propulsion device disposed at a predetermined position in front of the stern 2A is not limited to an electric propulsion device like the trolling motor 5, and may be an engine propulsion device including an outboard motor. Further, the propulsion device disposed at the stern 2A is not limited to the outboard motor 4, and may be any one of an inboard motor, an inboard/outboard motor, and a jet boat motor. Further, the propulsion device is not limited to an engine propulsion device and may be an electric propulsion device.

Example embodiments of the present invention can also be achieved by a process in which a program to achieve one or more functions of the above-described example embodiments is supplied to a system or an apparatus via a network or a non-transitory storage medium, and one or more processors of a computer of the system or the apparatus read and execute the program. The program and the storage medium storing the program may correspond to an example embodiment of the present invention. The present invention can also be implemented by a circuit (for example, an ASIC) that implements one or more functions.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion system comprising:

a first propulsion device that is steerable and located at a stern of a hull;

a second propulsion device that is steerable and located in front of the stern; and a controller configured or programmed to define and function as:

an obtaining unit to obtain information about a propulsion force of the first propulsion device in a forward direction, information about a propulsion force of the first propulsion device in the backward direction, and information about a propulsion force of the second propulsion device;

a determination unit to determine when to cause the first propulsion device during a lateral motion of the hull to generate a propulsion force in a direction in a first range including a component in the forward direction, and when to cause the first propulsion device during the lateral motion of the hull to generate a propulsion force in a direction in a second range including a component in the backward direction based on the information about the propulsion force in the forward direction of the first propulsion device, the information about the propulsion force in the backward direction of the first propulsion device, and the information about the propulsion force of the second propulsion device obtained; and a storage processor to store a content determined by the determination unit in a storage medium as determination information; wherein the determination unit is configured or programmed to:

compare a first difference between a minimum value of the propulsion force in the forward direction of the first propulsion device and a maximum value of the propulsion force of the second propulsion device with a second difference between a minimum value of the propulsion force in the backward direction of the first propulsion device and the maximum value of the propulsion force of the second propulsion device; and determine to cause the first propulsion device to generate the propulsion force in the direction in the first range when the first difference is less than the second difference, and to cause the first propulsion device to generate the propulsion force in the direction in the second range when the second difference is less than the first difference; and the controller is configured or programmed to control a steering angle of the first propulsion device and a steering angle of the second propulsion device based on the determination information.

2. The marine propulsion system according to claim 1, wherein the determination unit is configured or programmed to determine to generate the propulsion force in a direction included in a predetermined range among the first range and the second range when the first difference is identical to the second difference.

3. The marine propulsion system according to claim 1, wherein the minimum value of the propulsion force in the forward direction of the first propulsion device is a value based on the propulsion force of the component in the forward direction at a maximum steering angle of the first propulsion device; and the minimum value of the propulsion force in the backward direction is a value based on the propulsion force of the component in the backward direction at the maximum steering angle of the first propulsion device.

4. The marine propulsion system according to claim 1, wherein the first propulsion device includes an engine as a drive source; and the minimum value of the propulsion force in the forward direction and the minimum value of the propulsion force in the backward direction of the first propulsion device are values based on an engine rotation speed in which a throttle is fully closed.

5. The marine propulsion system according to claim 1, wherein the determination unit is configured or programmed to:

determine when to generate the propulsion force in the direction in the first range or to generate the propulsion force in the direction in the second range based on a distance between the first propulsion device and a center of gravity of the hull and a distance between the second propulsion device and the center of gravity of the hull in addition to the information about the propulsion force in the forward direction of the first propulsion device, the information about the propulsion force in the backward direction of the first propulsion device, and the information about the propulsion force of the second propulsion device.

6. The marine propulsion system according to claim 1, wherein the controller is configured or programmed to:

control the steering angle of the first propulsion device and the steering angle of the second propulsion device based on the determination information in response to an instruction to start a lateral motion mode, an instruction to start an automatic maneuvering mode, an instruction to start a joystick mode to control the first propulsion device and the second propulsion device based on an operation of a joystick, or an instruction to start a drive mode to control the first propulsion device and the second propulsion device based on an operation of a steering.

7. The marine propulsion system according to claim 6, wherein the steering includes a plurality of operation instructors including at least first operation instructors to provide an instruction to generate a propulsion force in the lateral direction to the hull and second operation instructors to provide an instruction to generate a propulsion force in a front-back direction.

8. The marine propulsion system according to claim 6, wherein the controller is configured or programmed to:

control the steering angle of the first propulsion device to generate the propulsion force in a direction in the first range and control the steering angle of the second propulsion device to generate the propulsion force in a direction in the second range when the determination information indicates to cause the first propulsion device to generate the propulsion force in a direction in the first range; and control the steering angle of the first propulsion device to generate the propulsion force in a direction in the second range and control the steering angle of the second propulsion device to generate the propulsion force in a direction in the first range when the determination information indicates to cause the first propulsion device to generate the propulsion force in a direction in the second range.

9. The marine propulsion system according to claim 6, wherein the controller is configured or programmed to control the first propulsion device and the second propulsion device based on the determination information and a maneuvering instruction of a lateral motion when a start of the lateral motion mode is instructed.

10. The marine propulsion system according to claim 9, wherein, when controlling the first propulsion device and the second propulsion device based on the maneuvering instruction, the controller is configured or programmed to:

maintain the steering angle of the second propulsion device to generate the propulsion force in the direction in the second range in controlling the steering angle of the first propulsion device to generate the propulsion force in the direction in the first range; and maintain the steering angle of the second propulsion device to generate the propulsion force in the direction in the first range in controlling the steering angle of the first propulsion device to generate the propulsion force in the direction in the second range.

11. The marine propulsion system according to claim 1, wherein the second propulsion device is located at a bow of the hull.

12. The marine propulsion system according to claim 1, wherein the second propulsion device includes a trolling motor.

13. A marine vessel comprising:

a hull; and a marine propulsion system including:

a first propulsion device that is steerable and located at a stern of a hull;

a second propulsion device that is steerable and located in front of the stern; and a controller configured or programmed to define and function as:

an obtaining unit to obtain information about a propulsion force of the first propulsion device in a forward direction, information about a propulsion force of the first propulsion device in the backward direction, and information about a propulsion force of the second propulsion device;

a determination unit to determine when to cause the first propulsion device during a lateral motion of the hull to generate a propulsion force in a direction in a first range including a component in the forward direction, and when to cause the first propulsion device during the lateral motion of the hull to generate a propulsion force in a direction in a second range including a component in the backward direction based on the information about the propulsion force in the forward direction of the first propulsion device, the information about the propulsion force in the backward direction of the first propulsion device, and the information about the propulsion force of the second propulsion device obtained; and a storage processor to store a content determined by the determination unit in a storage medium as determination information; wherein the determination unit is configured or programmed to:

compare a first difference between a minimum value of the propulsion force in the forward direction of the first propulsion device and a maximum value of the propulsion force of the second propulsion device with a second difference between a minimum value of the propulsion force in the backward direction of the first propulsion device and the maximum value of the propulsion force of the second propulsion device; and determine to cause the first propulsion device to generate the propulsion force in the direction in the first range when the first difference is less than the second difference, and to cause the first propulsion device to generate the propulsion force in the direction in the second range when the second difference is less than the first difference; and the controller is configured or programmed to control a steering angle of the first propulsion device and a steering angle of the second propulsion device based on the determination information.

14. A control method for a marine propulsion system including a first propulsion device that is steerable and located at a stern of a hull and a second propulsion device that is steerable and located in front of the stern, the control method comprising:

obtaining information about a propulsion force of the first propulsion device in a forward direction, information about a propulsion force of the first propulsion device in the backward direction, and information about a propulsion force of the second propulsion device;

determining when to cause the first propulsion device during a lateral motion of the hull to generate a propulsion force in a direction in a first range including a component in the forward direction, and when to cause the first propulsion device during the lateral motion of the hull to generate a propulsion force in a direction in a second range including a component in the backward direction based on the information about the propulsion force in the forward direction of the first propulsion device, the information about the propulsion force in the backward direction of the first propulsion device, and the information about the propulsion force of the second propulsion device obtained;

storing a content determined in a storage medium as determination information; and controlling a steering angle of the first propulsion device and a steering angle of the second propulsion device based on the determination information; wherein the determining includes:

comparing a first difference between a minimum value of the propulsion force in the forward direction of the first propulsion device and a maximum value of the propulsion force of the second propulsion device with a second difference between a minimum value of the propulsion force in the backward direction of the first propulsion device and the maximum value of the propulsion force of the second propulsion device; and determining to cause the first propulsion device to generate the propulsion force in the direction in the first range when the first difference is less than the second difference, and to cause the first propulsion device to generate the propulsion force in the direction in the second range when the second difference is less than the first difference.

* * * * *